US006119277A

United States Patent [19]

Chiang

[11] Patent Number: 6,119,277

[45] Date of Patent: Sep. 19, 2000

[54] SWIMMING GOGGLES

[76] Inventor: Herman Chiang, 2F, No. 634-9, Ching-Ping Rd., Chung-Ho City, Taipei Hsien, Taiwan

[21] Appl. No.: 09/209,559

[22] Filed: Dec. 11, 1998

[51] Int. Cl.[7] ..... A61F 9/02

[52] U.S. Cl. ..... 2/428; 2/452

[58] Field of Search ..... 2/428, 430, 445, 2/426, 452; 351/43, 155, 156

[56] References Cited

U.S. PATENT DOCUMENTS

| | | | |
|---|---|---|---|
| 5,502,844 | 4/1996 | Alvarado | 2/428 X |
| 5,596,771 | 1/1997 | Hsu et al. | 2/428 |
| 5,857,221 | 1/1999 | Geneve et al. | 2/428 |
| 5,926,855 | 7/1999 | Brodbeck | 2/426 |

*Primary Examiner*—Peter Nerbun
*Attorney, Agent, or Firm*—Pro-Techtor International Services

[57] ABSTRACT

The invention relates to the presentation of a new construction of swimming goggles, comprising: two lens frame main bodies, each lens frame main body accommodating a lens, and, at two opposite ends of a longer side are a first joint and a second joint; at least one string that is sequentially pulled through the first and second joints of the aforementioned two lens frame main bodies, maintaining an appropriate separation between the two lens frame main bodies, and winding along the rims of the lens frame main bodies, by thus structural characteristics, the user will be able to adjust the distance between the two lens frame main bodies, in order to adjust the length of the nose bridge; meanwhile, the length extending from the winding string will serve directly as a headband.

8 Claims, 9 Drawing Sheets

(III-III)

SWIMMING GOGGLES

FIELD OF THE INVENTION

The invention relates to a type of swimming goggles specially used in swimming pools, particularly to a new construction of swimming goggles with a nose bridge that may be subjected to stepless adjustment, and with the simultaneous function of a headband.

BACKGROUND OF THE INVENTION

Conventionally, a prior art of swimming goggles for the purpose of swimming pools has been disclosed in U.S. Pat. Nos. 5,802,620, 5,524,300 and 3,605,116, and ROC Patent Application No. 83200405, etc. Though the nose bridge structure disclosed in said prior art can be adjusted, the adjustable scope is quite limited to, generally, three steps. The types of user's face are varied and numerous, it is obviously impossible to satisfy different users with such a three-step adjustment. Therefore, some users would feel especially uncomfortable when they wear such models with three-step adjustment that could not satisfy them. Some products may result in water seepage in case of poor suitability. In view of this drawback, it becomes imperative to come up with a type of swimming goggles that will be able to suit various configurations of different consumers' nose bridges.

OBJECTIVES OF THE INVENTION

The objective of the new construction of swimming goggles is to present a type swimming goggles with stepless adjustment of nose bridge length, so completely and originally designed that the separation between the eyes can be freely adjusted by the user, to suit the user's nose bridge and enable comfortable wearing.

Another objective of the new construction of swimming goggle is to present a type of swimming goggles equipped with the function of adjustable nose bridge and the function of a headband device.

CHARACTERISTICS OF THE INVENTION

The invention is characterized mainly in that, the formation of the nose bridge in said swimming goggles involves the following: no less than one string is pulled from the inside of the lens frame main body, via the top and the bottom, to the outside along the rim of the lens frame main body, maintaining an appropriate distance between the two lens frame main bodies, then wound to the top and bottom rims of another lens frame main body; in other words, said nose bridge is formed by maintaining an appropriate distance between the two lens frame main bodies on the string, by thus a structural characteristic, the user will be able to adjust the separation of the two lens frame main bodies on the string, to achieve the adjustment of the length of nose bridge.

In said characteristics, the two strings are respectively in series connection with, via the top and the bottom, and wound around the two lens frames. Besides, said strings are made of adequately flexible material to enable more comfortable wearing.

Another characteristic of the new construction of swimming goggles lies in said string that connect with, and wound around, the lens frame main bodies, and further extend to from a headband.

DETAILED DESCRIPTION OF PREFERRED EMBODIMENT

Figure 1:
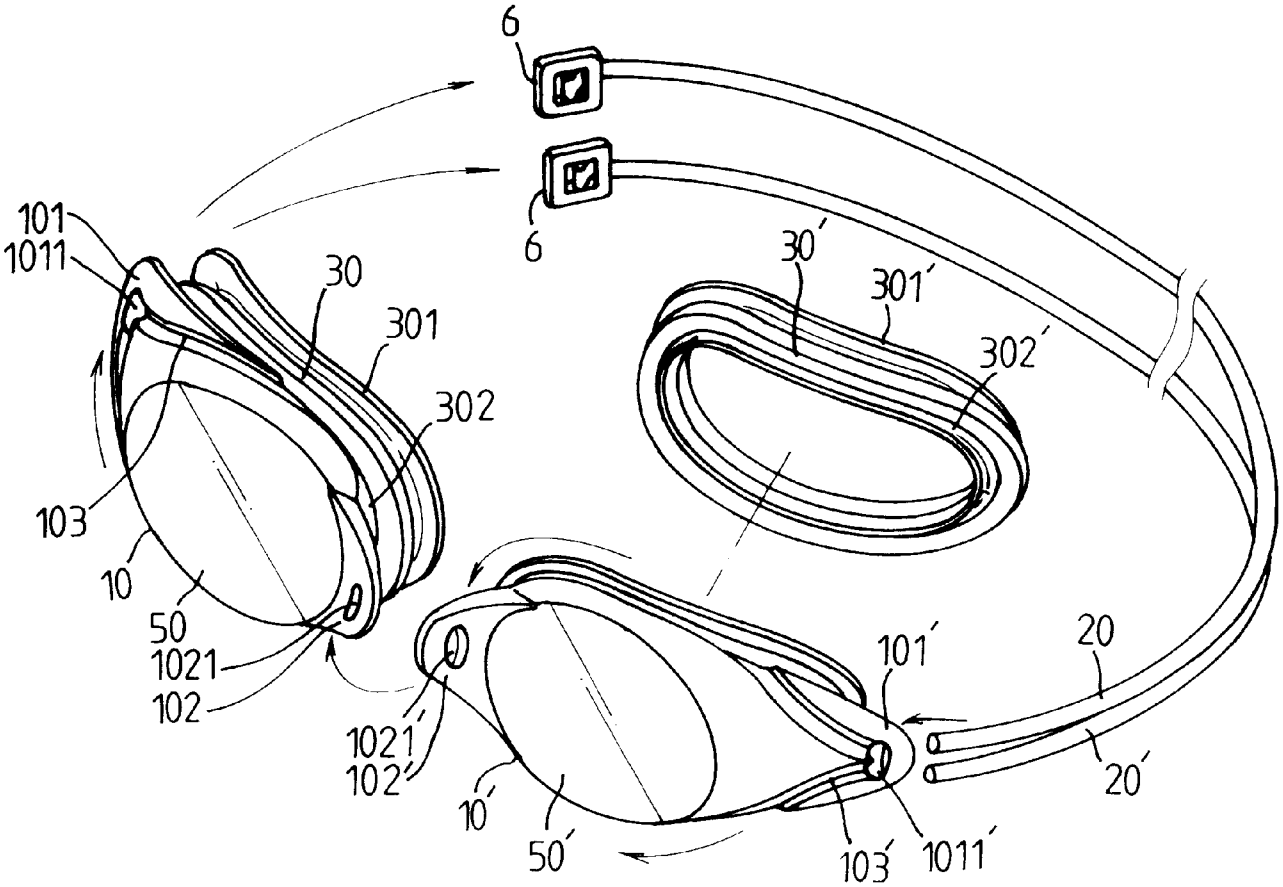
FIG. 1 is a perspective view of the new construction of swimming goggles.

Referring to FIG. 1, the invention of swimming goggles 1 comprises mainly the following: two lens frame main bodies 10 and 10', two strings 20 and 20' and two protecting pads 30 and 30'; wherein, said two lens frame main bodies 10 and 10' are located one on the left and the other on the right side, respectively accommodating lens 50 and 50'; said two lens 50 and 50' are monoblock formed with the lens frame in this example of embodiment, they may be planted and fixed onto the lens frame main bodies in the process of mass production. On the outside ends of the two lens frame main bodies 10 and 10' are two first joints 101 and 101', while on the inside ends of the two lens frame main bodies 10 and 10' are two second joints 102 and 102'; on the first and second joints 101, 101' and 102, 102' are joining holes 1011, 1011' and 1021, 1021', said joining holes 1011, 1011' and 1021, 1021' in this example of embodiment are elongated round holes, but in actual production they may be two round holes in alignment; one thing worth mentioning is that, in case said joining holes are elongated round holes, their inner diameter will be equivalent to the diameter of the two strings; in case they are two round holes in alignment, the inner diameter of each round hole will be equivalent to the diameter of one single string, so designed that the two strings can be pulled through and tightly fastened together. On the rims of the two lens frame main bodies 10 and 10' are streamlined fixing grooves 103 and 103', said fixing grooves 103 and 103' are depressed to an arch shape on the rim of the lens frame main bodies 10 and 10', serving to accommodate and position the two strings 20 and 20' (to be described later).

The two strings 20 and 20' in the section view of this example of embodiment are shown to be round, but in actual production they can be flattened strips, oval shapes and made of flexible materials, respectively pulled through the aforementioned joining holes 1011, 1011' and 1021, 1021'; in the embodiment view, said strings extends to become headbands, on the headband is an adjusting buckle 6 that serves to adjust the length of the headband. The protecting pads 30, 30' are respectively on the sides of the two lens frame main bodies 10 and 10' away from the lens 50 and 50', involving face contacting parts 301 and 301' with adequate flexibility for the purpose of comfortable contact with the user's face; as well as for the purpose of better suction to prevent seepage. Where the protecting pads 30, 30' and the winding strings 20, 20' are in contact, there are depressions 302, 302' (refer to FIG. 3B) to partially accommodate and position said strings 20, 20'.

Figure 2:
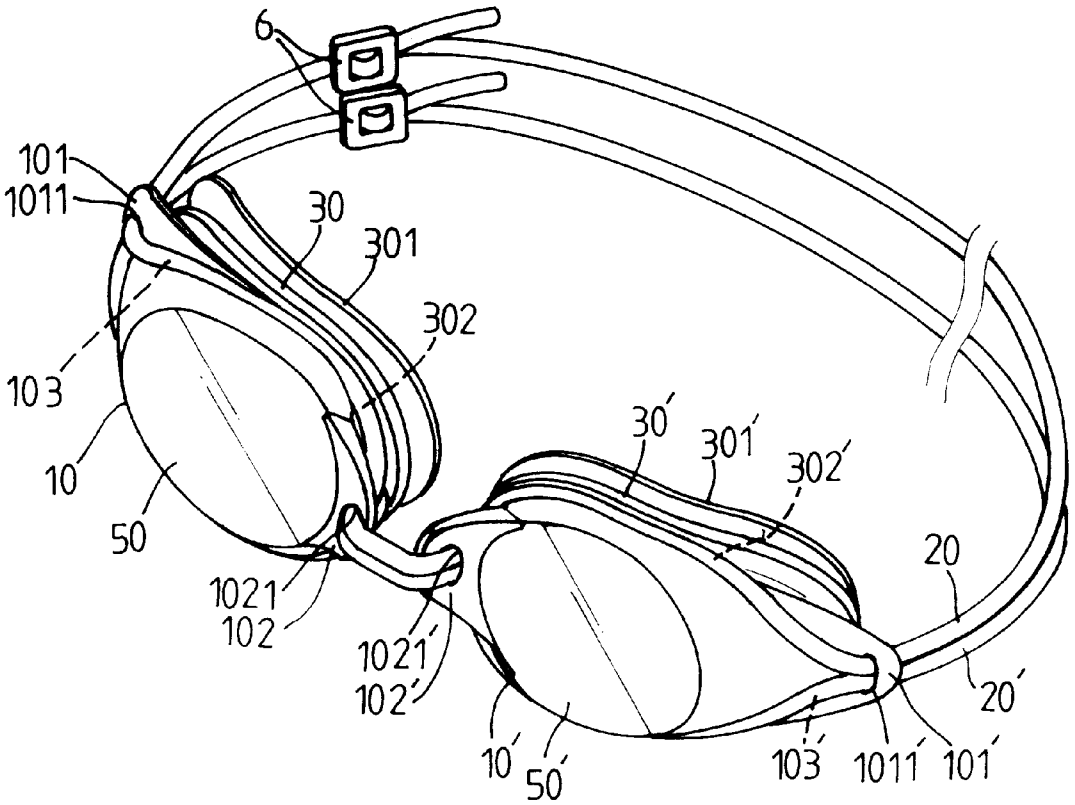
FIG. 2 is a perspective assembled view of the new construction of swimming goggles.
Figure 3A:
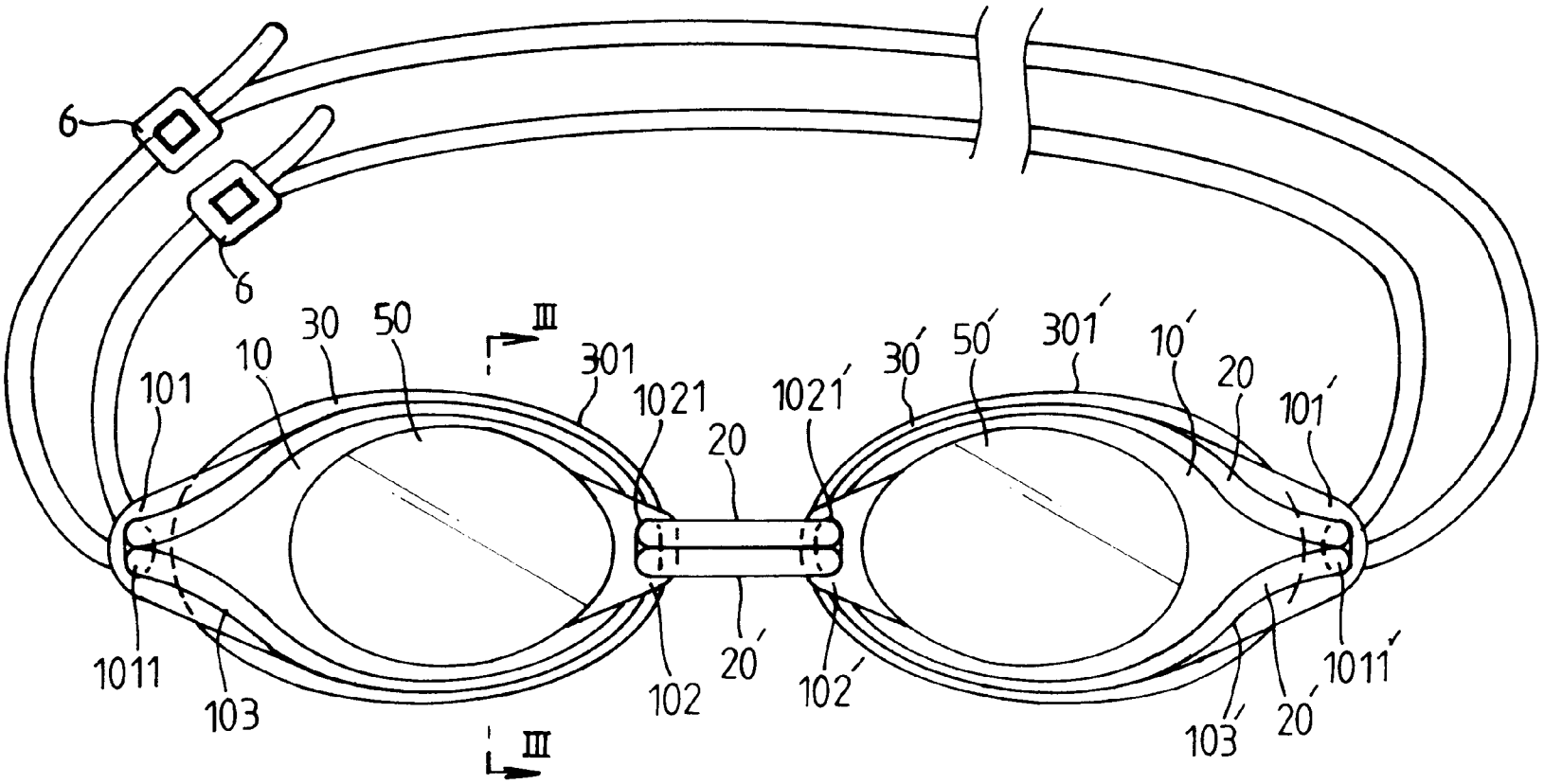
FIG. 3A is a front view of the new construction of swimming goggles.
Figure 3B:
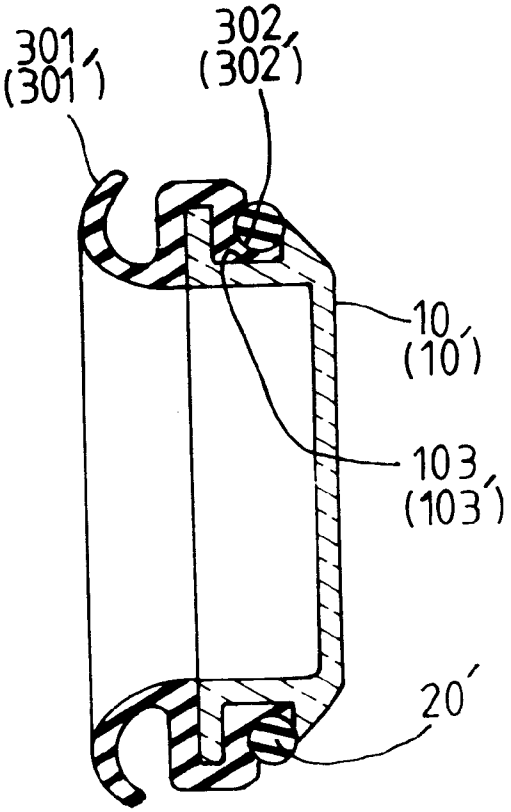
FIG. 3B is a section view of the section marked "III—III" in FIG. 3A.

Please refer to FIGS. 2, 3A and 3B, to assemble the invention of swimming goggles, the two strings 20 and 20' are pulled respectively from the first joint 101 of the lens frame main body 10, via the top and the bottom, along the rim of the lens frame main body, positioned from the fixing groove 103 to the second joint 102, maintaining an appropriate separation from the other lens frame main body 10', then wound to the second joint 102' of another lens frame main body 10', to the upper and lower rims, positioned in the fixing groove 103' and through the first joint 101', to compose a pair of swimming goggles with stepless adjustment of nose bridge, the whole unit can be easily and conveniently assembled.

Figure 4B:
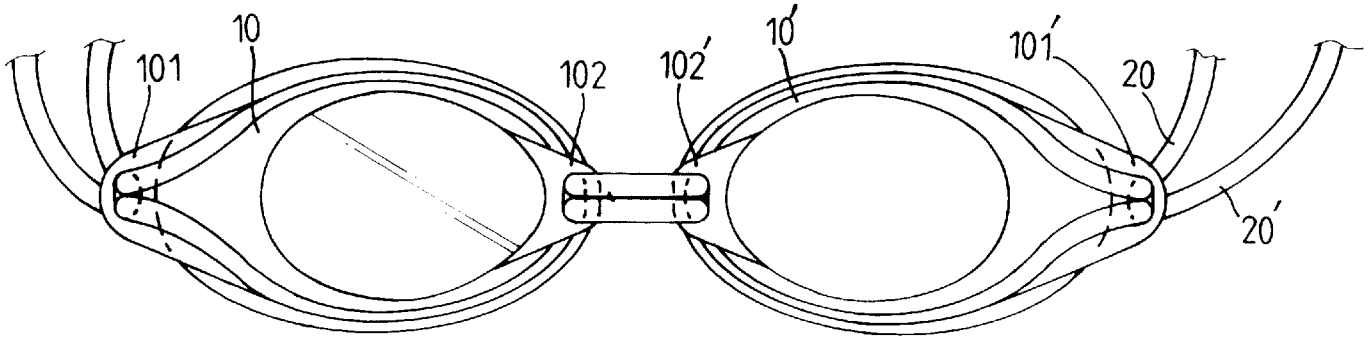
FIGS. 4A and 4B illustrate the adjustment of eye separation in the new construction of swimming goggles.
Figure 4A:
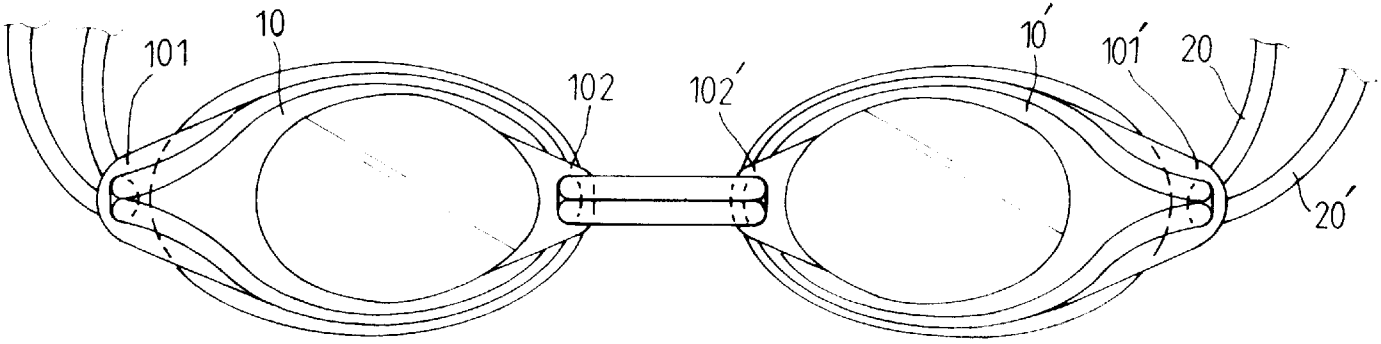

Please refer to FIGS. 4A and 4B, in the adjustment of eye separation of the swimming goggles, in case the separation is to be shortened, all the user has to do is first pull the string 20 (20') at one side of the first joint 101 (101'), then the lens frame main bodies 10 (10') will come closer (shown in FIG. 4A). in case the eye separation is to be lengthened, all the user has to do is pull the string 20 (20') at one side of the second joint 102 (102'), then the lens frame main bodies 10 (10') will be separated (see FIG. 4B). Since the nose bridge of the invention of swimming goggles is determined by moving the two lens 10 and 10' on the strings 20 and 20', it enables stepless adjustment to suit the nose bridge conditions of different users who will feel comfortable.

Figure 5A:
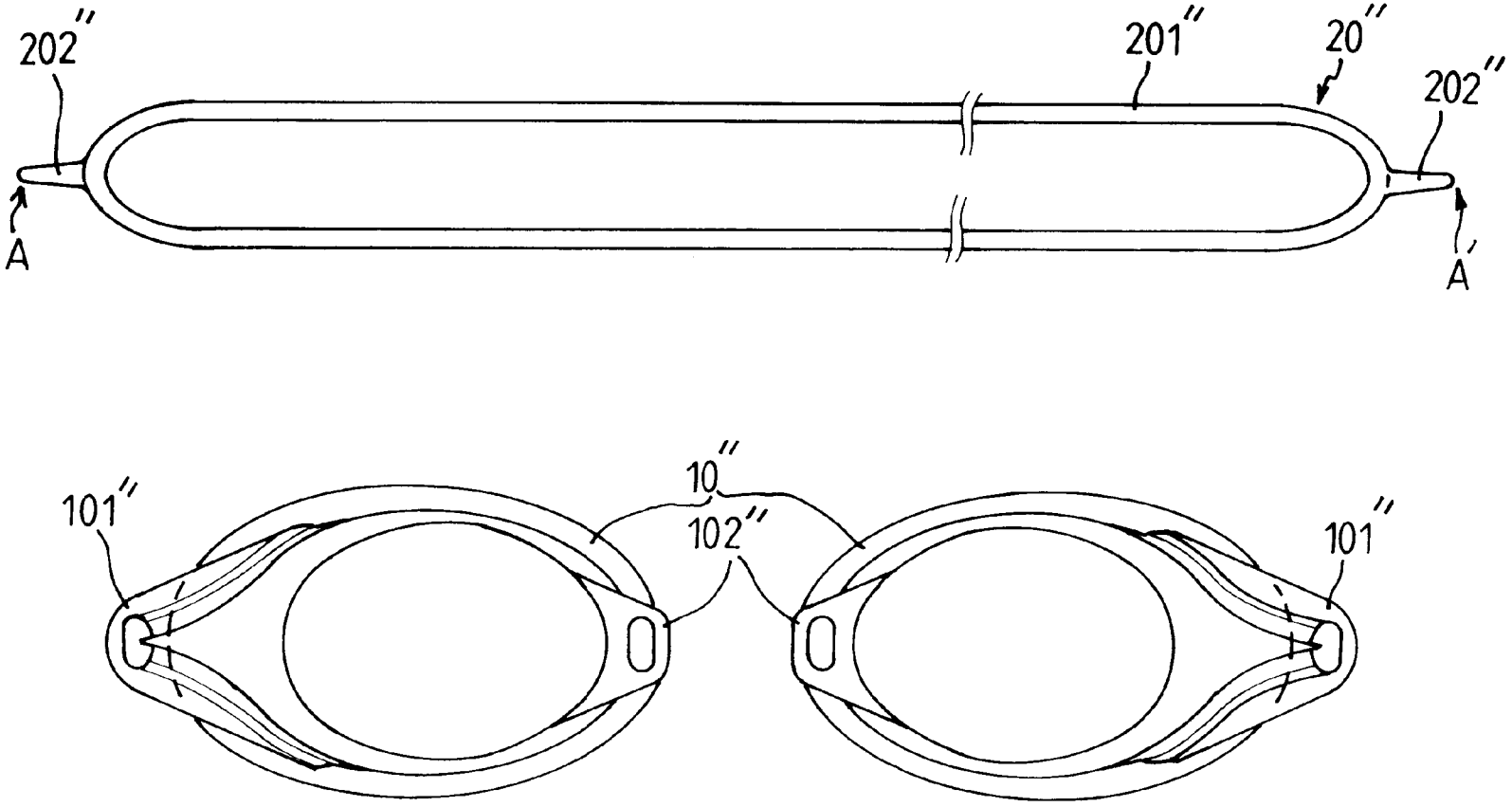
FIGS. 5A, 5B, 5C and 5D illustrate a second embodiment of the new construction of swimming goggles.
Figure 5B:
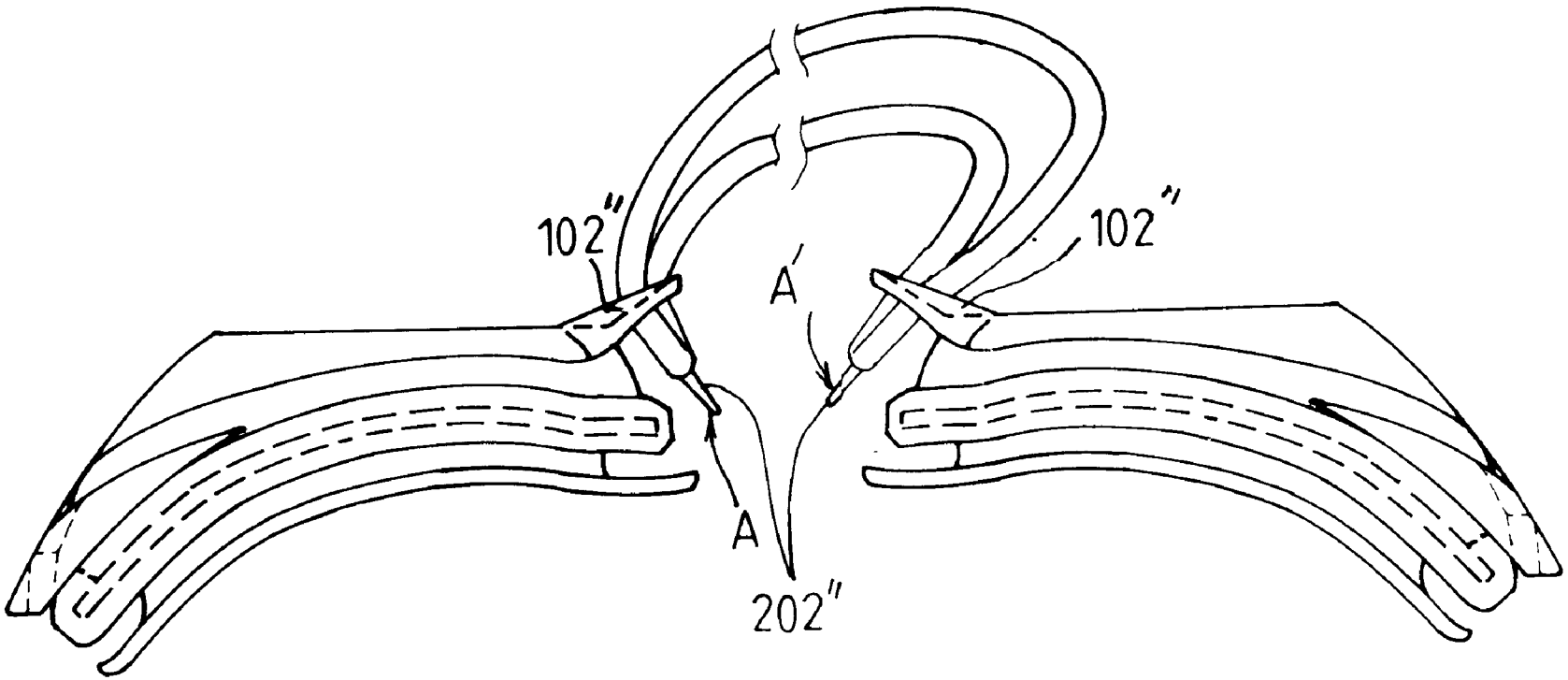
Figure 5C:
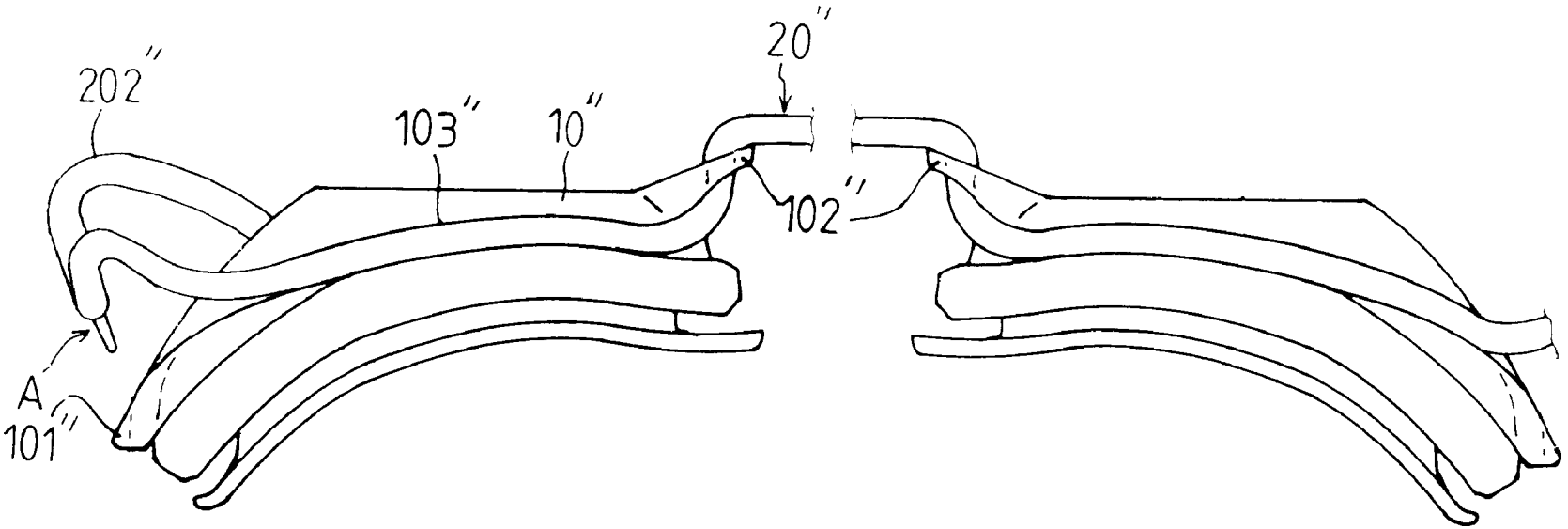
Figure 5D:
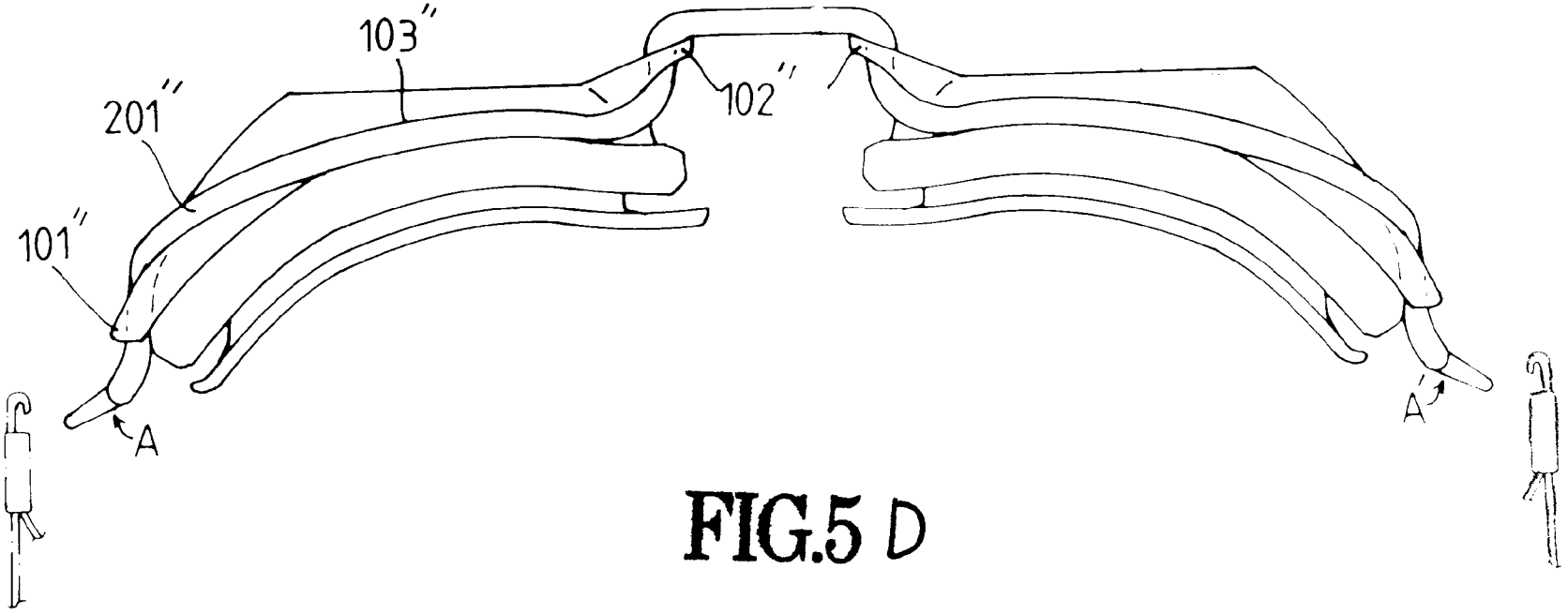

Please refer to FIGS. 5A, 5B, 5C and 5D, which illustrate a second example of embodiment of the invention, in this embodiment, said string 20" can also be a ring unit, the circumference of said ring unit is equivalent to the rim of the two lens frame main bodies 10", involving a longer side 201" and a shorter side 202" (FIG. 5A), wherein, said shorter side 202" is designed in a needle-end shape to facilitate assembly, the shorter end 202" can be respectively pulled through the first and second joints 101", 102" on the lens frame main body 10". Please try to understand the assembling process in FIG. 5B, wherein, the shorter sides 202' are respectively pulled through the second joints 102". In FIGS. 5C and 5D, the shorter sides 202" are pulled outside to the first joint 201", then the longer side 201" of the string 20" is accommodated in the rim depression 103" on the lens frame main body 10", thus the two lens frame main bodies can be connected in a series, while the adjustment of the separation between the two lens frame main bodies 10" can be made by pulling the string 20" as shown in FIGS. 4A and 4B.

Since the two lens frame main bodies of the invention of swimming goggles are wound as one unit by the strings, each lens frame unit can be sold separately, in other words, either a two-piece unit or a single lens frame body can be sold, to provide consumers with multiple choices, such as for replacement of a single lens or one goggle of different style or color.

Summing up, it has been explained that the subject matter will be able to achieve the objectives of the invention, so it has satisfied the requirements for a patent of new design, however, the aforementioned description refers only to a preferred embodiment, it is declared that all modifications and variations deriving from the above description shall be included in the intent of the subject claims.

What is claimed is:

1. Swimming goggles comprising:

two lens frame main bodies, each said lens frame main body containing a lens, and each said lens frame main body has at two opposite ends a first joint and a second joint extending outward from a main portion of said lens frame main body, two strings are wound separately from the top and the bottom along the rims of the lens frame main bodies, on an outside end of said two lens frame main bodies are joining parts which serve to connect said lens frame main bodies with the headband device, on the top and bottom of the rims of said two lens frame main bodies are fixing grooves serving to position said strings, said fixing grooves include depressed arcs along the rims of the lens frame main bodies, said depressed arcs serving to accommodate part of the strings;

at least one string pulled through the first and second joints of said two lens frame main bodies, maintaining a separation between the two lens frame main bodies, said at least one string is wound along the rims of the lens frame main bodies, wherein said at least one string has a circular cross section and is made of flexible material; and a headband device connected near an outside edge of the two lens frame main bodies, thereby enabling the user to adjust the separation of the two lens frame main bodies, which adjusts the length of a nose bridge;

wherein on the first and second joints on said lens frame main bodies are joining holes, said joining holes are elongated and have an inside diameter equivalent to the diameter of the two strings, such that said joining holes receive the two strings so that the two strings can be tightly fastened together.

2. Swimming goggles comprising:

two lens frame main bodies, each said lens frame main body containing a lens, and each said lens frame main body has at two opposite ends a first joint and a second joint extending outward from a main portion of said lens frame main body, on the outside end of said two lens frame main bodies are joining parts which serve to connect said lens frame main bodies with the headband device, on the top and bottom of the rims of said two lens frame main bodies are fixing grooves serving to position said strings, said fixing grooves include depressed arcs along the rims of the lens frame main bodies, said depressed arcs serving to accommodate part of the strings;

at least one string having a circular cross section and being made of flexible material, said at least one string being pulled through the first and second joints of said two lens frame main bodies, maintaining a separation between the two lens frame main bodies, said at least one string is wound along the rims of the lens frame main bodies, said at least one string is a single ring unit, said ring unit having a longer side and a shorter side, the shorter side of said ring unit having a needle-end shape to facilitate penetration through the joining holes and being pulled sequentially through the first and second joints of the two lens frame main bodies, and the longer side of said ring unit winding around the rim of the lens frame main bodies to connect the two lens frame main bodies; and a headband device connected near an outside edge of the two lens frame main bodies, thereby enabling the user to adjust the separation of the two lens frame main bodies, which adjusts the length of a nose bridge;

wherein on the first and second joints on said lens frame main bodies are joining holes, said joining holes are elongated and have an inside diameter equivalent to the diameter of the two strings, such that said joining holes receive the two strings so that the two strings can be tightly fastened together.

3. The swimming goggles as recited in claim 1, wherein said joining holes are two holes in alignment, the diameter of each hole being equivalent to the diameter of a single string, such that said joining holes receive the two strings so that the two strings can be tightly fastened together.

4. The swimming goggles as recited in claim 2, wherein said joining holes are two holes in alignment, the diameter of each hole being equivalent to the diameter of a single string, such that said joining holes receive the two strings so that the two strings can be tightly fastened together.

5. The swimming goggles as recited in claim 3, wherein on the side of rim where said lens frame main body is in contact with the user's face is a flange, said flange serving to position a protecting pad.

6. The swimming goggles as recited in claim 4, wherein on the side of rim where said lens frame main body is in contact with the user's face is a flange, said flange serving to position a protecting pad.

7. The swimming goggles as recited in claim 5, wherein there is a depression at the location where said protecting pad and the wound string are in contact, said depression serving to partially accommodate and position the string.

8. The swimming goggles as recited in claim 6, wherein there is a depression at the location where said protecting pad and the wound string are in contact, said depression serving to partially accommodate and position the string.

* * * * *